United States Patent [19]

Harmon et al.

[11] Patent Number: 4,662,440

[45] Date of Patent: May 5, 1987

[54] METHODS FOR OBTAINING WELL-TO-WELL FLOW COMMUNICATION

[75] Inventors: Richard A. Harmon, Ponca City, Okla.; Harry A. Wahl, Hilo, Hi.

[73] Assignee: Conoco Inc., Ponca City, Okla.

[21] Appl. No.: 876,962

[22] Filed: Jun. 20, 1986

[51] Int. Cl.[4] ..... E21B 43/24; E21B 43/26; E21B 43/30

[52] U.S. Cl. ..... 166/245; 166/263; 166/271; 166/272

[58] Field of Search ..... 166/245, 263, 271, 272, 166/259, 308

[56] References Cited

U.S. PATENT DOCUMENTS

| | | | |
|---|---|---|---|
| 2,695,163 | 11/1954 | Pearce et al. | 166/245 |
| 3,004,594 | 10/1961 | Crawford . | |
| 3,048,221 | 8/1962 | Tek | 166/259 X |
| 3,270,816 | 9/1966 | Staadt . | |
| 3,329,207 | 7/1967 | Shock et al. . | |
| 3,387,888 | 6/1968 | Shock et al. | 299/4 |
| 3,416,606 | 12/1968 | Watanabe . | |
| 3,613,785 | 10/1971 | Closmann et al. | 166/271 |
| 3,682,246 | 8/1972 | Closmann | 166/271 |
| 3,709,295 | 1/1973 | Braunlich, Jr. et al. | 166/245 |
| 3,858,658 | 1/1975 | Strubhar et al. | 166/271 X |
| 3,990,514 | 11/1976 | Kreinin et al. | 166/271 |
| 4,047,569 | 9/1977 | Tagirov et al. | 166/308 |
| 4,265,310 | 5/1981 | Britton et al. | 166/259 |
| 4,305,463 | 12/1981 | Zakiewicz | 166/245 |
| 4,334,579 | 6/1982 | Gregg | 166/245 X |
| 4,461,349 | 7/1984 | Wunderlich | 166/245 |

OTHER PUBLICATIONS

Reynolds, J. J.; Scott, J. B.; Pophan, J. L. and Coffer, H. F., "Hydraulic Fracture-Field Test to Determine Areal Extent and Orientation", Jour. Pet. Tech., Apr., 1961, pp. 371-376.

Closmann, P. J. and Smith, Richard A., "Temperature Observations and Steam Zone Rise in the Vicinity of a Steam-Heated Fracture", Soc. of Pet. Engr. Jour. (Aug., 1983), pp. 575-586.

*Primary Examiner*—George A. Suchfield

*Attorney, Agent, or Firm*—A. Joe Reinert

[57] ABSTRACT

A process for establishing well-to-well flow communication between a plurality of wells penetrating a subsurface formation is provided. A common fracture network is created by initiating a fracture from a first well, and then propagating that fracture from the first well to a second well. When the fracture has reached the second well, fracturing fluid is injected into the second well and thereby further propagates the fracture to a third well, and so on, so that the fracture is successively propagated to all of the wells. Such a fracture can be located adjacent either a lower or an upper boundary of a tilted subsurface formation, as desired. Techniques are also provided for reducing uneven areal distribution of injection fluids which are injected into fractures.

25 Claims, 7 Drawing Figures

METHODS FOR OBTAINING WELL-TO-WELL FLOW COMMUNICATION

BACKGROUND OF THE INVENTION

1. Field Of The Invention

The invention relates to processes for establishing a common fracture network interconnecting a plurality of wells.

2. Description Of The Prior Art

Numerous processes involve the establishment of a common flow network connecting a plurality of wells intersecting an underground formation.

One example of such a process is a steamflood process for enhancing the production of hydrocarbons, particularly in situations involving heavy viscous hydrocarbon deposits. Also, such techniques of establishing a common fracture network have application in solution mining.

Often, the well-to-well communication network is created by hydraulically induced fracturing of the subsurface formation.

One such prior art technique is disclosed in U.S. Pat. No. 3,990,514 to Kreinin et al. The Kreinin et al. patent discloses a method of coal beds. In that technique, a fracture is propagated between a first and second well by pumping injection fluid under pressure into the second well while closing the first well and simultaneously opening any other surrounding wells. This creates a hydraulic fracture directed from the second well into communication with the first well. To subsequently connect a third well to the fracture network previously created between the first and second wells, injection fluid is pumped into the third well while closing in the second well and opening the first well and any other surrounding wells. This causes a fracture to initiate at the third well and travel back to the second well, presumably into substantial communication with the first created fracture. Thus, the Kreinin et al. disclosure does not disclose the successive propagation of an initial fracture from well to well, but rather it initiates new fractures at subsequent wells and propagates them back into communication with the existing fracture.

The Kreinin et al. patent discloses a technique for creating the fracture substantially adjacent the lower boundary of a formation. This is accomplished by casing the wells to a point shortly above the lower boundary of the formation, thus leaving an uncased portion of the well adjacent the lower boundary of the formation. Thus, the fracture system is created between these uncased portions of the wells which are located relatively near the lower boundary of the formation. The Kreinin et al. patent also discloses an example in which the subsurface formation was inclined or tilted relative to the ground surface, but this inclination was apparently only incidental, and was not utilized to control the location of the hydraulically created fracture.

One particular type of process in which the formation of a well-to-well flow communication network between a plurality of wells is important, is a fracture-assisted steamflood process developed by the assignee of the present invention as disclosed in U.S. Pat. No. 4,265,310 to Britton et al. As disclosed in the Britton et al. patent, one of the significant features of this fracture-assisted steamflood process is that a central injection well of a steamflood pattern is connected to the associated surrounding production wells by a fracture through which steam is injected at rates sufficient to maintain the fracture in parted condition.

In the Britton et al. process, a single fracture is initiated at the central injection well and propagated radially outward in all directions therefrom to intersect each of the outlying production wells in a typical well pattern such as an inverted five-spot, seven-spot or nine-spot pattern. Since each production well will typically be associated with more than one injection well, the fractures initiated at the injection wells may be communicated with each other, particularly in the permeable zones created immediately adjacent the production wells. Again, however, as was the case with the Kreinin et al. '514 patent, the overall fracture network which may intercommunicate the field is not created by the continuous propagation of a single fracture; instead, multiple independently initiated fractures are connected together.

SUMMARY OF THE INVENTION

The present invention provides several techniques which greatly improve the ability to establish a common fracture network between a plurality of wells to provide well-to-well flow communication.

One significant aspect of this technique is the continuous successive propagation of a single fracture from one well to another in a continuous fashion. This is accomplished by initiating a fracture from a first well, and propagating that fracture from the first well to a second well. When the fracture has reached the second well, fracturing fluid is then injected into the second well and thereby further propagates the same fracture to a third well. This process is repeated as necessary with regard to other wells as the fracture reaches those other wells, by injecting fracturing fluid into the other wells and thereby further propagating the same fracture until the fracture intersects each well of the plurality of wells. This establishes a common fracture network linking all of the plurality of wells.

In another aspect of the invention, techniques are provided for locating the common fracture network substantially adjacent either an upper or lower boundary of a tilted subsurface formation. This is accomplished by initially propagating the fracture substantially horizontally until it intersects or strikes the boundary of interest, and then the fracture propagates substantially along the bedding planes defining the boundary.

Also, techniques are provided for reducing uneven areal sweep of injection fluid in a well pattern utilizing a common fracture network which communicates the wells.

Generally, uneven areal sweep of injection fluid injected into a particular injection well can be reduced by propping the fracture adjacent that injection well, and subsequently injecting the injection fluid initially at below parting pressures so as to establish flow of injection fluid in all directions from the injection well.

When it is determined that there is excessive injection fluid flowing toward particular production wells, or when it is anticipated that there will be excessive flow toward particular production wells, that too can be remedied by asymmetrically distributing proppant into the fracture adjacent the injection well in question, so as to subsequently reduce the flow of injection fluid toward those particular production wells.

This is accomplished by simultaneously injecting fluid into the particular production wells toward which it is desired to reduce fluid flow, while injecting fracturing fluid containing the proppant material into the injection well in question. The simultaneous injection of fluid into the production wells causes proppant material injected into the injection well to be distributed away from those production wells into which fluid is being injected. This distribution of proppant adjacent the injection well subsequently enhances flow of an injection fluid such as steam in the desired radial directions to provide a more even areal sweep of the formation surrounding the injection well.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 3, a substantially horizontal hydraulic fracture has been initiated from the down dip well.

In FIG. 4, the fracture was propagated substantially horizontally until in the direction of the up dip well it intersected the lower boundary of the formation, at which point the fracture turned upward and followed the bedding planes defining the lower boundary of the formation. The fracture has propagated upward until it has intersected the nearest up dip well B.

In FIG. 5, fracturing fluid has been injected into the second well B to continue to propagation of the fracture up dip from well B until it has intersected the most up dip well C.

DETAILED DESCRIPTION OF THE PREFERRED EMBODIMENTS

Figure 1:
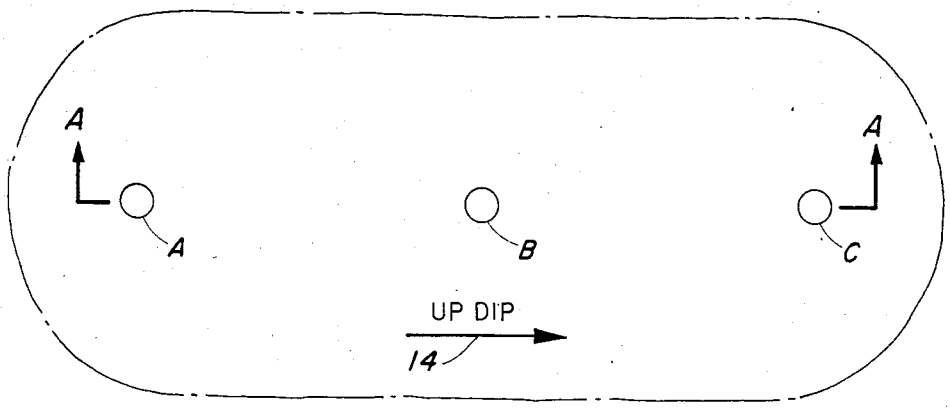
FIG. 1 is a schematic plan view of three wells intersecting a tilted subsurface formation.
Figure 2:
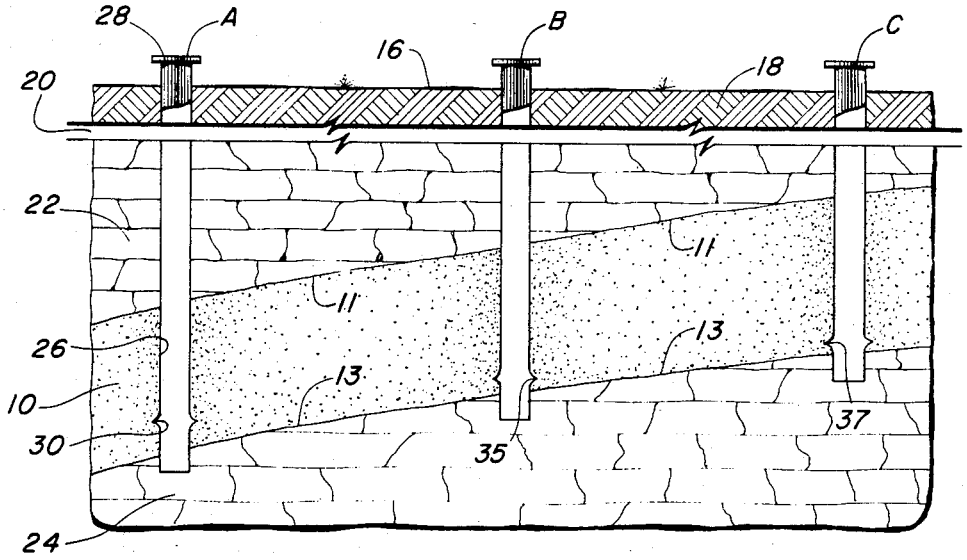
FIG. 2 is a schematic elevation view taken along section line A—A of FIG. 1, showing three wells intersecting the tilted formation.

Referring now to the drawings, and particularly to FIGS. 1 and 2, a subsurface formation 10, seen in cross section in FIG. 2, is defined between an upper boundary 11 and a lower boundary 13.

The plane of the subsurface formation 10 is tilted in a direction generally indicated by arrow 14. As seen in FIG. 2, the formation 10 tilts upwardly from left to right in the various cross-sectional views shown in FIGS. 2–6.

In FIGS. 2–6, references to up dip directions indicate directions running from left to right, while references to down dip directions indicate directions running from right to left.

Figure 7:
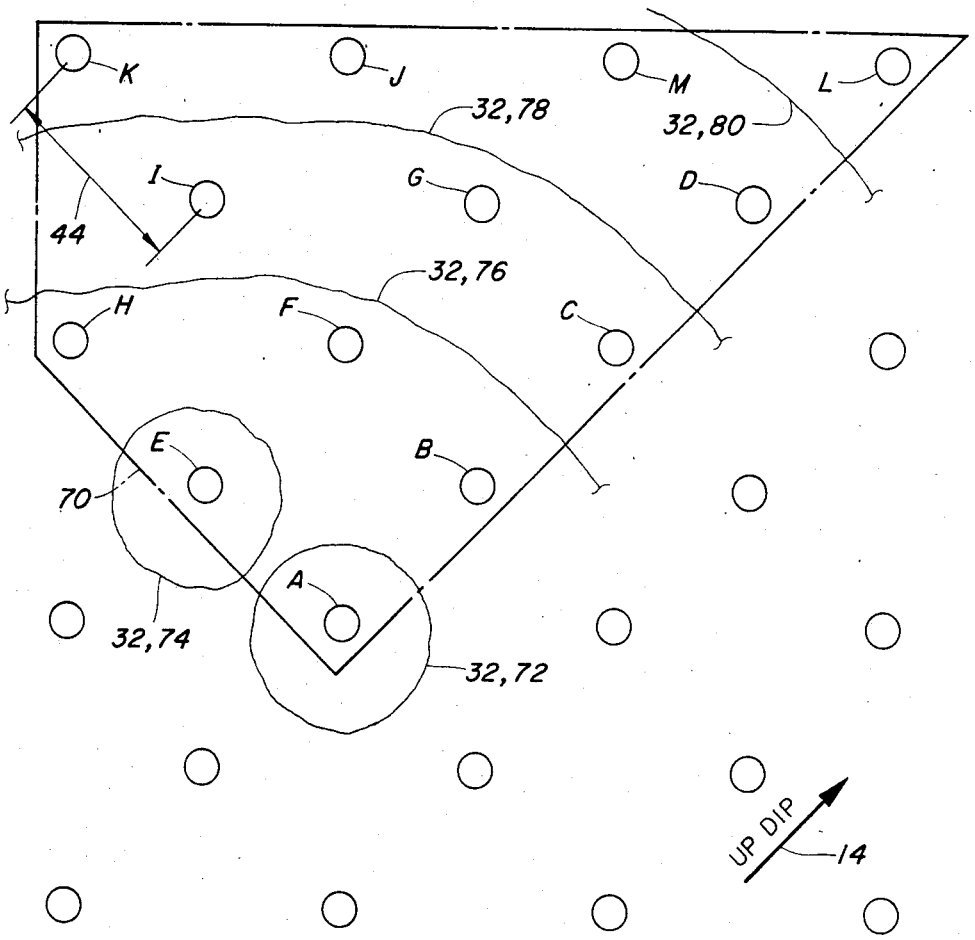
FIG. 7 is a schematic plan view of a series of five-spot well patterns including the wells A, B and C of FIG. 1.

In FIG. 1, only three wells as shown and designated as A, B and C. It will be understood that wells A, B and C will generally be a part of a larger pattern of wells as shown in FIG. 7. Although wells A through C may be newly drilled for the purpose of carrying out the methods of the present invention, they may also be previously existing wells.

In FIG. 2, wells A, B and C are schematically shown in elevation cross-section view.

In FIG. 2, terrain 16 comprising overburden 18 shown with breakline 20, and overburden 22 lie over the subsurface formation 10 which is underlain by stratum 24.

Each of the wells, such as well A, is shown in only a very schematic fashion having an outline of a well bore such as 26, and being capped by a well head such as 28. It will be understood that each of the wells may be constructed in a conventional fashion including one or more strings of casing which may be cemented to the subsurface formation through which it passes.

In FIG. 2, well A has been notched at 30 in preparation for the initiation of a hydraulic fracture. Up dip wells B and C have also been notched at 35 and 37.

The notch 30 can be created by numerous means. A preferred method of creating notch 30 is by rotating a hydraulic cutting tool to form the notch 30 through casing and cement defining the well bore 26. Such notching techniques are described in greater detail in U.S. Pat. No. 4,265,310 to Britton et al., which is incorporated herein by reference. The well could also be prepared for fracture initiation by perforating the well at location 30.

FIGS. 2–5 illustrate sequential steps in a process for establishing well-to-well flow communication between a plurality of wells, including wells A, B and C, which penetrate the subsurface formation 10.

Figure 3:
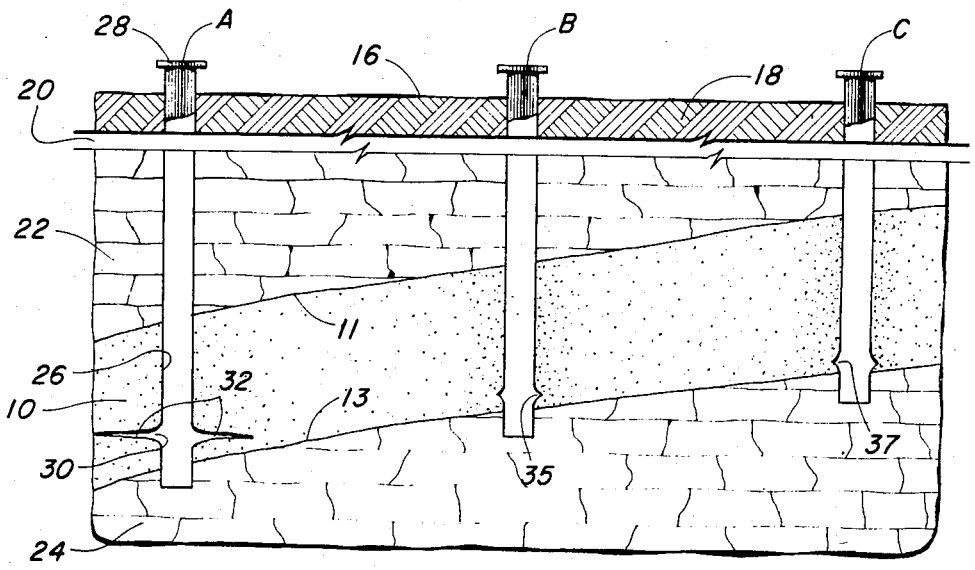
FIGS. 3, 4 and 5 are similar to FIG. 2, and sequentially illustrate the creation of a common fracture network communicating the three wells in accordance with the principles of the present invention.

In FIG. 3, a fracture 32 has been initiated from notch 30 and has propagated a relatively short distance radially outward in all directions from well A. The fracture 32 is oriented substantially horizontally so that it initially propagates in a plane substantially normal to the length of well A. In FIG. 3, the fracture 32 is seen in cross section so that the left-hand cross-sectional profile of fracture 32 is seen to be propagating down dip relative to formation 10, while the right-hand profile of fracture 32 is seen to be propagating up dip relative to formation 10.

In FIG. 3, the right-hand profile of fracture 32 is propagating horizontally toward the up dip wells, and has not yet intersected the lower boundary 13 of formation 10.

Figure 4:
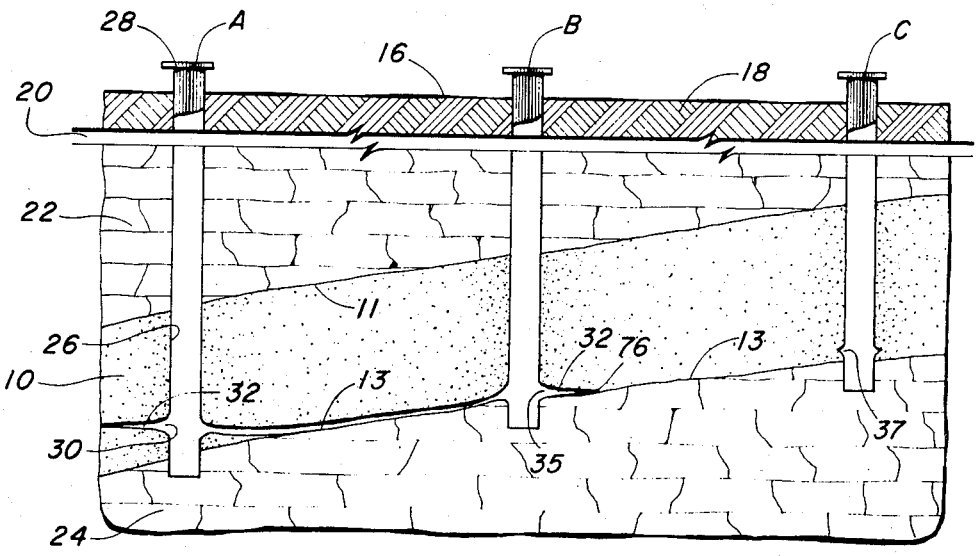

In FIG. 4, the fracture 32 is seen to have intersected the lower boundary 13 of formation 10 and then turned parallel to the lower boundary 13 and propagated further up dip where it has intersected the next up dip well B, as is further explained below.

Figure 5:
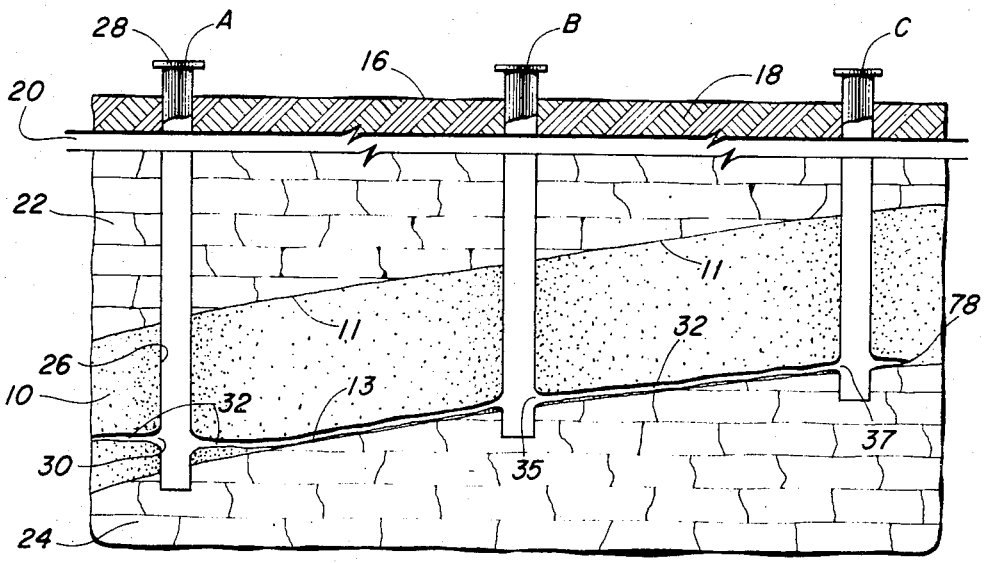

When the fracture 32 has reached well B and a flow connection between wells A and B is assured, injection of fracturing fluid at fracturing rates into well B and notch 35 thereof is quickly begun. The injection of fracturing fluid into well B and into the fracture 32 which has intersected well B, will further propagate the fracture 32 further up dip to well C as shown in FIG. 5.

Although only three successive wells are shown in FIG. 4, it will be apparent that the fracture 32 can be further propagated from well C as necessary to other wells intersecting the formation 10, by injecting more fracturing fluid into well C when the fracture 32 intersects well C. These additional wells can lie substantially along the dip line 14 of the formation, or they can be offset transversely from the line of wells A, B and C; it being generally preferred, however, that the area of a formation being fractured be covered by starting at the most down dip well and generally propagating to the nearest adjacent up dip well as the fracture is propagated from one well to another. The subsequent up dip wells, however, do not necessarily lie directly in a path parallel to the line of dip 14. This is further explained below with regard to the example of FIG. 7.

Thus, the fracture 32 provides a common fracture network 32 linking all of the wells such as wells A, B and C. This provides well-to-well flow communication between the wells A, B and C. This path of communication can then be used in a process involving the injection of fluids into the formation 10, such as for example, a fracture-assisted steamflood process similar to that disclosed in the Britton et al. U.S. Pat. No. 4,265,310.

As is apparent in FIG. 4, the fracture 32 which was initially propagating in a substantially horizontal direction as shown in FIG. 3, intersected the lower boundary 13 of formation 10 and then began following the bedding planes defining lower boundary 13 so that the fracture 32 propagated up dip substantially along the lower boundary 13.

The notch 30 was initially placed in well A near the lower boundary 13 of formation 10 so that the fracture 32 would intersect lower boundary 13 soon after the fracture was initiated. Thus, substantially the entire fracture 32 is located adjacent the lower boundary 13 of formation 10.

The method of the present invention can generally be stated as including the following sequence of steps. First, the fracture 32 is initiated from the first well A. The fracture 32 is propagated from the first well A to a second well B. When the fracture 32 has reached the second well B, fracturing fluid is injected into the second well B to thereby further propagate the fracture 32 to the third well C. The step of injecting fracturing fluid into subsequent wells such as second well B is repeated as necessary with regard to any other wells to thereby further propagate the fracture 32 until the fracture intersects each well of the pattern of wells involved.

It will be appreciated that as the fracture front advances away from a given well such as well A, and the injection of fracturing fluid into subsequent wells such as B, is begun, the further advance of the fracture front will be much more strongly affected by injection of fluid into those subsequent wells such as B than it will due to any further injection of fluid into the initial wells such as A.

Typically, after the fracture 32 has reached the next successive well, a rate of injection of fracturing fluid into the initial well A can be reduced while fracturing fluid is being injected into the subsequent wells such as B.

Even later, the injection of fracturing fluid into well A can be terminated.

Similarly, when the fracture front has advanced sufficiently far away from any of the other injecting wells such as well B, and the further injection of fracturing fluid into the well B does not significantly affect further advancement of the fracture front, the injection of fluid into well B can likewise be terminated.

It will be appreciated that the reduction of the injection of fracturing fluid into any particular wells such as wells A or B will depend upon the characteristics of the particular formation, and the decision for reduction and subsequent termination of the injection of fracturing fluid will be made on a case-by-case basis based upon the effect of injection of fluid into that well on further advancement of the fracture front.

It has been documented that a fracture will propagate in the manner generally just described in Reynolds, et al., "Hydraulic Fracture—Field Test to Determine Areal Extent and Orientation", Jour. Pet. Tech. (April, 1961), which is incorporated herein by reference.

The fracture evaluation in the Reynolds, et al. paper was conducted in a laminated sandstone containing numerous hard streaks. The well was perforated in a single plane in the center of a 25-foot-thick pay interval. Fourteen test wells were drilled in order to determine the geometry of the fracture created in the oil-producing well. The core results show that the fracture extended into the lower part of the pay in the up dip direction cutting across several hard streaks. Similarly, the fracture extended into the upper part of the pay in the down dip direction. On the structure strike, the fracture tended to remain at the same depth and follow the bedding planes. This behavior can be used as described above to direct the fracture 32 along the lower boundary 13 of the formation 10. This fracture location is advantageous in oil recovery by steam injection through the fracture.

Application Of The Present Invention to Steamflooding

Such a common fracture network 32 adjacent the lower boundary 13 of formation 10 is particularly useful in a fracture-assisted steamflood process like that disclosed in Britton et al., U.S. Pat. No. 4,265,310, in which steam is to be injected into the formation 10 to recover heavy hydrocarbon deposits therefrom.

Such a steamflood process can be best explained with regard to FIG. 7 which schematically illustrates in plan view a portion of a field covered by a plurality of five-spot injection patterns, each of which is defined by a central injection well and four surrounding producing wells placed on the corners of a square. Some of the wells in FIG. 7 have been designated A-M.

The five wells F, H, I, J and K, for example, would comprise one five-spot pattern with well I being the central injection well and wells F, H, K, and J being the outlying producing wells associated with injection well I.

Steam, which can generally be described as a hot aqueous fluid at a temperature above 100° C., is injected into the injection well I.

In accordance with the methods of Britton et al., U.S. Pat. No. 4,265,310, steam is injected into the injection wells such as well I, at a very high rate and a pressure sufficient to part the fracture network 32 for a substantial portion of a distance such as 44 from the injection well I to surrounding production wells such as well K, while producing fluids from the production wells F, H, K and J.

It will be understood that the fracture 32 will generally have already been formed prior to beginning steam injection. When it is said that the steam is injected at a very high rate and pressure sufficient to "part the fracture network 32", it is meant that the steam is injected at a rate and pressure sufficient to float a previously created fracture; it is not meant that the steam is used to create the fracture.

It has previously been determined that in steamflood processes associated with heavy oil formations, the vertical sweep of injected steam is for the most part upward from the point of injection, and there is very little vertical sweep downward from the point of injection. This is discussed for example in Closmann, P. J. and Smith, Richard A., "Temperature Observations and Steam Zone Rise in the Vicinity of a Steam-Heated Fracture", Soc. of Pet. Engr. Jour., p. 575 (Aug. 1983).

The present invention provides an extremely good means for controlling the placement of a fracture substantially adjacent the lower boundary of the heavy oil containing formation.

As a result of the location of the fracture network 32 substantially along the lower boundary 13 of the formation 10 an enhanced vertical sweep of the formation 10 by injected steam is provided in a fracture-assisted steamflood process like that of the Britton et al. '310 patent, as compared to a similar process wherein the fracture network is located substantially above the lower boundary 13 of the formation 10.

More Generalized Description Of The Invention With Regard To FIG. 7

FIG. 7 is a schematic plan view of a number of adjacent five-spot well patterns including the wells A, B and C of FIGS. 1–6.

With regard to FIG. 7, the process of the present invention can be more generally described.

Assume, for example, that that portion of the field shown in FIG. 7 surrounded by the phantom line 70 is to be steamflooded by a fracture-assisted steamflood process like that described in the Britton et al. '310 patent.

It is noted that in FIG. 4, the orientation of the drawing has been changed relative to FIG. 1, but the drawing of FIG. 1 is a portion of the drawing of FIG. 7, so that wells A, B and C previously described in detail do still lie along a line generally parallel to the up dip line 14.

To create a common fracture system such as the fracture system 32 previously illustrated in FIGS. 2–5, along the bottom of the formation 10 within the phantom line 70, the fracture will be initiated at one or more of the most down dip wells within the area 70, namely wells A, E and H.

The fracture can either be initiated at well A, with subsequent injection into well E not occurring until the fracture has extended from well A to well E, or fractures can be initiated substantially simultaneously in both the down dip wells A and E, or in all three of the most down dip wells A, E and H.

The wells A, E and H can generally be described as a plurality of wells which are generally aligned transversely to the direction 14 of dip of formation 10.

Assuming, by way of example only, that it is decided to begin the fracture by substantially simultaneously initiating fractures near the bottom of formation 10 from down dip wells A and E, the process would generally proceed as follows.

The fronts of fracture system 32 propagating outward from wells A and E are indicated schematically in FIG. 7 as the generally radially outward extending fracture fronts 32, 72 and 32,74, respectively.

The portion of the advancing fracture fronts 72 and 74 in the up dip direction 14 would propagate substantially as represented in FIGS. 3 and 4, i.e., that is they would propagate substantially horizontally until striking the lower boundary 13 of formation 10 at which time they will turn in a direction parallel to the lower boundary 13 which they will follow as they travel further up dip.

At a later point in time, the fracture front will have reached the location designated as 32,76 where it has now intersected up dip wells B and F, and the transversely adjacent well H. The location of fracture front 32,76 generally corresponds to the location of fracture system 32 as shown in FIG. 4, with the forward edge of fracture system 32 in FIG. 4 being designated by the numeral 76 corresponding to the fracture front 32,76.

As the fracture front intersects each of the wells B, F and H, in turn, the injection of fracturing fluid into those wells will preferably begin substantially immediately.

At a still later point in time, the advancing fracture front will have reached a location designated as 32,78 which generally corresponds to the illustration of fracture system 32 in FIG. 5. Again, as the fracture system in turn intersects wells C, G and I, the injection of fracturing fluid into each of those wells will preferably begin substantially immediately.

The injection of fracturing fluid into the early wells such as wells A and E may be reduced, or even terminated, when its contribution to the advancing fracture front no longer is effective. This will in many cases be based upon practical considerations such as the number of available frac trucks. Generally, the trucks will be leapfrogged one ahead of the other to make the most advantageous use of the units which are available.

For example, after the fracture front has reached the location 32,76, and injection is begun in wells H, F and B, those trucks injecting fluid into wells A and E may then be moved to wells G and C in anticipation of the front reaching those locations.

Of course, it is not necessary to actually move the trucks or pumps. The injection wells may be changed by use of piping connecting a stationary pump to desired injection wells.

Also, a given pump can be connected to more than one injection well. For example, a pump could have its output divided between wells A and B. As the fracture front advances away from well B, the amount of fluid directed to well A could be gradually reduced while simultaneously increasing the amount of fluid directed to well B.

Continuing with the general description of the placement of the fracture within the phantom area 70 of FIG. 7, at a still later point in time, the fracture may have reached a location such as that designated as 32,80.

Again, as the advancing fracture front in turn intersected wells D, M, J and K, it is understood that the injection of fluid would be started in those wells if necessary to advance the fracture front to the next up dip wells. It is certainly possible, however, as for example in the case of well K, that fluid might not be injected into that well. For example, if the injection of fluid into well I will be sufficient to move the fracture front into intersection with well J and well K, there may be no need to inject fluid into well K. Similarly, there may be no need to inject fluid into well J if the injection fluid into wells C and G will be sufficient to advance the fracture front up dip to both wells D and M.

Injection of fluid into well D or possibly both wells D and M will then be performed to finally advance the fracture system into intersection with well L at which point in time a common fracture system 32 will have been created covering the entire portion 70 of the field which is desired to be steamflooded.

Although in the description given above, it has been indicated that preferably injection of fracturing fluid into any one of the up dip wells will begin substantially immediately upon the fracture front reaching the well, it should be understood that it will not always be necessary to substantially immediately begin injecting fluid into those up dip wells, although it is generally preferred to do so.

In some instances, depending upon the formation characteristics, it may be possible to hold the fracture open at the intersected up dip wells by holding pressure on the other injecting wells for extended periods of time, or it may even be possible to allow the fracture to close and to subsequently reopen it. It will be understood, however, that in some formations, there will be a danger of being unable to reopen the fracture at the desired location at a later time, and thus it is generally preferred to substantially immediately begin injection of fracturing fluid in each up dip well as the advancing fracture front reaches that well so as to insure that a common continuous fracture system is created joining all of the wells.

Figure 6:
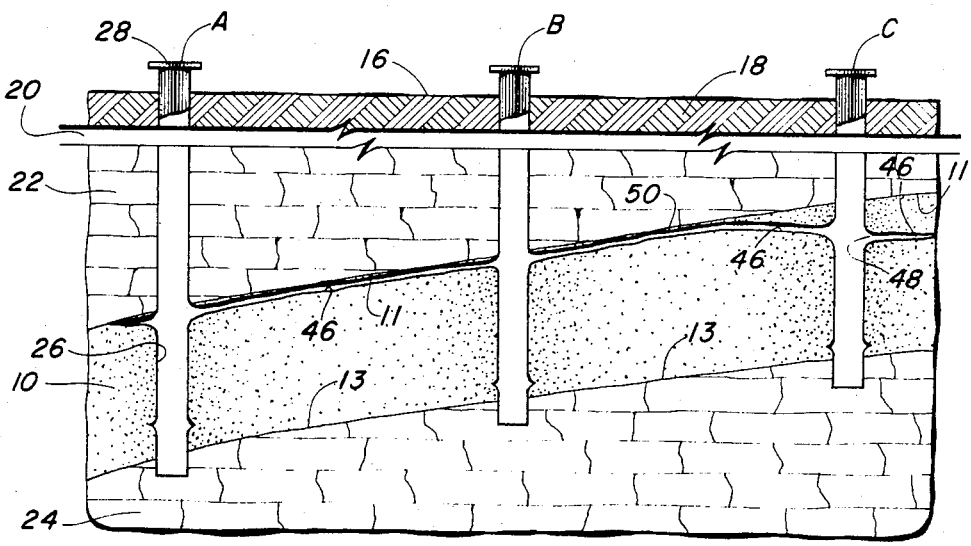
FIG. 6 is a schematic elevation view similar to FIG. 2, but illustrating the formation of a common fracture network communicating the three wells substantially adjacent the upper boundary of the formation. This fracture was initiated at the up dip well C near the upper boundary of the formation, and subsequently propagated down dip along the upper boundary of the formation.

Embodiment Of FIG. 6

It will be appreciated that the techniques of the present invention can also be utilized to create a common fracture system which lies substantially adjacent the upper boundary 11 of formation 10.

Such a fracture system is illustrated in FIG. 6 and designated by the numeral 46.

The fracture 46 is initiated at a notch 48 in well C near the upper boundary 11 of formation 10.

The fracture 46 propagates down dip from well C in a substantially horizontal direction until it intersects upper boundary 11 at approximately point 50, at which point it turns parallel to the bedding planes defining upper boundary 11 and travels further down dip along upper boundary 11 until it intersects well B.

When the fracture 46 intersects well B, the injection of fracturing fluid into well B and into the fracture 46 is quickly begun, thus further propagating the fracture 46 down dip until it intersects well A.

Thus, the fracture system 46, as shown in FIG. 6, is created substantially adjacent the upper boundary 11 of formation 10. The fracture system 46 provides a common flow network communicating the wells such as A, B and C.

Reduction Of Uneven Areal Sweep Of Injection Fluids

After a common fracture network has been created interconnecting a plurality of wells such as wells A through M shown in FIG. 7, injection fluids will be injected into the formation to carry out the ultimate process for recovering petroleum, minerals or the like from the formation.

As previously discussed, a fracture-assisted steamflood process such as that disclosed in the Britton et al., U.S. Pat. No. 4,265,310, is a good example of such a process.

In a process like that of the Britton et al. '310 patent, steam is injected into central injection such ahs well I, and sweeps radially outward from those injection wells toward the surrounding production wells to sweep heavy oil deposits to those production wells where they can be produced.

It is preferred that the injected steam sweep uniformly throughout the areal extent of the well pattern. Thus, it is preferred that the advancing stem front from a given injection well such as I sweep the distance to each of its surrounding production wells in substantially the same amount of time. In the circumstance of uniformly placed wells such as the five-spot pattern defined in FIG. 7 by wells I, F, H, K and J, this preferred steam sweep would be to extend substantially uniformly radially outward from well I to provide a substantially circular advancing steam front. It will be understood, however, that generally speaking, the advancing steam front will not necessarily be desired to extend at the same rate in all directions from the central injection well. For example, the wells may not be evenly spaced and it may still be desired to have the steam front sweep the distance from the injection well to each of the outlying production wells in substantially the same time.

Additionally, the steam front advancing from well I will generally not be uniform due to an uneven permeability of the formation 10, uneven flow in the fracture, or other factors. In many instances, there will be channels in the formation 10 which may cause a much larger than desired portion of the injected steam to flow toward one or more of the surrounding production wells. This will cause those portions of the formation located between the injection well and the other producing wells to not be completely or efficiently swept by the injected steam.

One technique which is preferably used to provide a more uniform steam front around the injection well I is to inject fracturing fluid containing a proppant material into the injection well I, thereby propping the fracture 32 adjacent injection well I. Then, steam will be initially injected into the injection well I at pressures below the parting pressure of fracture 32 so as to provide a more symmetrical heated zone around injection well I and to thereby initiate steam flow in all directions from the injection well I.

Although the provision of such a propped fracture around the injection well I will generally improve the uniformity of steam injection around that well, it will still often be the case that an uneven steam distribution will develop around injection well I.

Once a specific uneven distribution is recognized or anticipated in a given well pattern, another technique can be used to reduce that uneven areal sweep of the injected steam.

Assume for example that after steam injection is begun, it is determined that steam is flowing more rapidly to production well K than to production wells H, F and J. This can be determined by many methods, one of which is the observation of produced fluid temperature. It is desirable to detect uneven steam distribution as early as possible and to effect a correction in steam distribution as early as possible.

In the situation outlined above it is desirable to reduce the flow of steam toward production well K, and accordingly increase the flow of steam toward the other production wells H, F and J.

This can be accomplished to a significant extent by injecting fracturing fluid containing proppant material into the injection well I and into the fracture 32, while simultaneously injecting fluid under pressure into production well K. This injection of fluid into production well K will cause a greater portion of the proppant material which is being simultaneously injected into injection well I to be placed in the fracture 32 in directions toward production wells H, F and J, and generally away from production well K.

Subsequently, when steam injection is restarted in injection well I, the uneven areal sweep of injected steam previously experienced will be reduced.

Thus it is seen that the methods of the present invention readily achieve the ends and advantages mentioned as well as those inherent therein. While certain preferred embodiments of the invention have been illustrated and described for the purposes of the present disclosure, numerous changes in the arrangement and sequence of steps can be made by those skilled in the art which changes are encompassed within the scope and spirit of the present invention as defined by the appended claims.

What is claimed is:

1. A process for establishing well-to-well flow communication between a plurality of wells penetrating a subsurface formation comprising:

(a) initiating a fracture from a first well of said plurality of wells;

(b) propagating said fracture from said first well to a second well of said plurality of wells to establish flow communication between said first and second wells;

(c) when said fracture has reached said second well, injecting fracturing fluid at fracturing rates into said second well and thereby further propagating said fracture to a third well of said plurality of wells;

(d) repeating step (c) as necessary with regard to other wells of said plurality of wells as said fracture reaches said other wells, by injecting fracturing fluid at fracturing rates into said other wells and thereby further propagating said fracture until said fracture intersects each well of said plurality of wells; and (e) thereby linking said plurality of wells through a common fracture network.

2. The process of claim 1, wherein:

step (c) is further characterized in that fracturing fluid is injected at fracturing rates into said second well substantially immediately after said fracture has reached said second well.

3. The process of claim 1, wherein:

said formation is a tilted formation, said second well being up dip from said first well, and said third well being up dip from said second well.

4. The process of claim 3, wherein:

step (a) is further characterized in that said fracture is initiated near a lower boundary of said formation.

5. The process of claim 4, wherein:

steps (b) and (c) are further characterized in that said fracture propagates in an up dip direction, from said first well to said second well and then to said third well, along said lower boundary of said formation so that said common fracture network is located substantially along said lower boundary.

6. The process of claim 5, said process further comprising the steps of:

(f) injecting steam into one or more of said wells, said one or more wells being then defined as injection wells, at a very high rate and a pressure sufficient to part the fracture network for a substantial portion of a distance from each of said injection wells to surrounding production wells of said plurality of wells while producing fluids from said production wells; and (g) wherein as a result of said location of said fracture network substantially along said lower boundary of said formation an enhanced vertical sweep of said formation by said injected steam is provided as compared to a similar process wherein said fracture network is located substantially above said lower boundary.

7. The process of claim 6, further comprising the step of:

prior to step (f), injecting fracturing fluid containing a proppant material into one of said injection wells and thereby propping said fracture adjacent said one injection well, and then injecting steam into said one injection well initially at below parting pressure conditions to provide a more symmetrical heated zone around said one injection well.

8. The process of claim 6, further comprising the steps of:

(h) reducing uneven areal sweep of steam injected into one of said injection wells in step (f) by:

(1) injecting fracturing fluid containing a proppant material into said one injection well and said one injection well;

(2) simultaneous with step (h)(1), injecting fluid into one or more adjacent production wells toward which it is desired to reduce steam flow, thereby causing a greater portion of said proppant material to be placed in said fracture adjacent said one injection well in directions away from said one or more adjacent production wells toward which it is desired to reduce steam flow; and (3) thereby subsequently reducing uneven areal sweep of steam injected into said one injection well at rates and pressures below those required to part the fracture.

9. The process of claim 3, wherein:

step (a) is further characterized in that said fracture is initiated as a substantially horizontal fracture; and steps (b) and (c) are further characterized in that said fracture first propagates up dip substantially horizontally from said first well until it intersects a lower boundary of said formation, and then said fracture propagates up dip along substantially said lower boundary of said formation so that said common fracture network is located substantially along said lower boundary.

10. The process of claim 9, wherein:

prior to step (a) said first well is horizontally notched at a desired point of initiation of said fracture.

11. The process of claim 10, wherein:

said horizontal notch is located near said lower boundary of said formation.

12. The process of claim 9, said process further comprising the steps of:

(f) injecting steam into one or more of said wells, said one or more wells being then defined as injection wells, at a very high rate and a pressure sufficient to part the fracture network for a substantial portion of a distance from each of said injection wells to surrounding production wells of said plurality of wells while producing fluids from said production wells; and (g) wherein as a result of said location of said fracture network substantially along said lower boundary of said formation an enhanced vertical sweep of said formation by said injected steam is provided as compared to a similar process wherein said fracture network is located substantially above said lower boundary.

13. The process of claim 12, further comprising the step of:

prior to step (f), injecting fracturing fluid containing a proppant material into one of said injection wells and thereby propping said fracture adjacent said one injection well, and then injecting steam into said one injection well initially at below parting pressure conditions to provide a more symmetrical heated zone around said one injection well.

14. The process of claim 12, further comprising the steps of:

(h) reducing uneven areal sweep of said hot aqueous fluid injected into one of said injection wells in step (f) by:

(1) injecting fracturing fluid containing a proppant material into said one injection well and into said fracture to prop said fracture adjacent said one injection well;

(2) simultaneous with step (h)(1), injecting fluid into one or more adjacent production wells toward which it is desired to reduce steam flow, thereby causing a greater portion of said proppant material to be placed in said fracture adjacent said one injection well in directions away from said one or more adjacent production wells toward which it is desired to reduce steam flow; and (3) thereby subsequently reducing uneven areal sweep of steam injected into said one injection well at rates and pressures below those required to part the fracture.

15. The process of claim 1, further comprising the step of:

(f) when said fracture has reached said second well in step (b) and injection of fracturing fluid into said second well has begun in step (c), reducing a rate of injection of fracturing fluid into said first well while still injecting fracturing fluid into said second well.

16. The process of claim 15, further comprising the step of:

(g) after step (f), stopping injection of fracturing fluid into said first well while still injecting fracturing fluid into said second well.

17. The process of claim 1, wherein:

said first, second and third wells are generally aligned in a first direction, and said formation is penetrated by a fourth well laterally offset from said first, second and third wells; and said process further includes the step of propagating said fracture in a second direction transverse to said first direction, from one of said first, second and third wells to said fourth well.

18. The process of claim 17, wherein:

said formation is a tilted formation, said second well being up dip from said first well, and said third well being up dip from said second well; and said first direction is substantially parallel to a direction in which said formation is tilted.

19. The process of claim 1, wherein:

said first well is one of a first pair of wells, said second well is one of a second pair of wells, and said third well is one of a third pair of wells;

said formation is a tilted formation, said second pair of wells being up dip from said first pair of wells and said third pair of wells being up dip from said second pair of wells;

step (a) is further characterized in that fractures are substantially simultaneously initiated from both wells of said first pair;

step (b) is further characterized in that said fractures are propagated from said first pair of wells to said second pair of wells as a substantially unitary fracture; and step (c) is further characterized in that when said substantially unitary fracture reaches each well of said second pair, fracturing fluid is in turn injected into each well of said second pair to thereby further propagate said substantially unitary fracture toward the wells of said third pair.

20. The process of claim 1, wherein:

said formation is a tilted formation, said second well being down dip from said first well, and said third well being down dip from said second well.

21. The process of claim 20, wherein:

step (a) is further characterized in that said fracture is initiated near an upper boundary of said formation.

22. The process of claim 21, wherein:

steps (b) and (c) are further characterized in that said fracture propagates in a down dip direction from said first well to said second well and then to said third well along said upper boundary of said formation so that said common fracture network is located substantially along said upper boundary.

23. The process of claim 20, wherein:

step (a) is further characterized in that said fracture is initiated as a substantially horizontal fracture; and steps (b) and (c) are further characterized in that said fracture first propagates down dip substantially horizontally from said first well until it intersects an upper boundary of said formation and then said fracture propagates down dip along said upper boundary of said formation so that said common fracture network is located substantially along said upper boundary.

24. The process of claim 23, wherein:

prior to step (a), said first well is horizontally notched at a desired point of initiation of said fracture.

25. The process of claim 24, wherein:

said horizontal notch is located near said upper boundary of said formation.

* * * * *